US011220935B2

(12) United States Patent
Suzuki et al.

(10) Patent No.: US 11,220,935 B2
(45) Date of Patent: Jan. 11, 2022

(54) ELECTROMAGNETIC CONTROL DEVICE, IN PARTICULAR FOR ADJUSTING CAMSHAFTS OF AN INTERNAL COMBUSTION ENGINE

(71) Applicant: Kendrion (Villingen) GmbH, Villingen-Schwenningen (DE)

(72) Inventors: Tsuneo Suzuki, Monchweiler (DE); Michael Tischtschenko, Trossingen (DE); Andreas Kammerer, Obereschach (DE)

(73) Assignee: Kendrion (Villingen) GmbH, Villingen-Schwenningen (DE)

( * ) Notice: Subject to any disclaimer, the term of this patent is extended or adjusted under 35 U.S.C. 154(b) by 154 days.

(21) Appl. No.: 16/330,698

(22) PCT Filed: Aug. 23, 2017

(86) PCT No.: PCT/EP2017/071217
§ 371 (c)(1),
(2) Date: Mar. 5, 2019

(87) PCT Pub. No.: WO2018/046298
PCT Pub. Date: Mar. 15, 2018

(65) Prior Publication Data

US 2021/0003046 A1 Jan. 7, 2021

(30) Foreign Application Priority Data

Sep. 7, 2016 (DE) ..... 10 2016 116 777.0

(51) Int. Cl.
*F01L 1/34* (2006.01)
*F01L 13/00* (2006.01)
(Continued)

(52) U.S. Cl.
CPC ..... *F01L 13/0036* (2013.01); *F01L 1/047* (2013.01); *F01L 2013/0052* (2013.01);
(Continued)

(58) Field of Classification Search
CPC ..... F01L 13/0036; F01L 1/047; F01L 2013/0052; F01L 2820/031; H01F 7/1646; H01F 7/1607
See application file for complete search history.

(56) References Cited

U.S. PATENT DOCUMENTS 9,759,172 B2 9/2017 Wolff et al.
2004/0201441 A1 10/2004 Elendt et al.
(Continued)

FOREIGN PATENT DOCUMENTS

CN 103154494 6/2013
DE 202006011904 12/2007
(Continued)

OTHER PUBLICATIONS

Chinese Patent Office, "First Office Action," and English translation thereof, issued for Chinese Patent Application No. 201780054783.3, dated Jun. 17, 2020, document of 15 pages.
(Continued)

*Primary Examiner* — Zelalem Eshete
(74) *Attorney, Agent, or Firm* — Akerman LLP; Peter A. Chiabotti

(57) ABSTRACT

The application relates to an electromagnetic control device, in particular for adjusting camshafts or a camshaft section of an internal combustion engine, comprising: an energizable coil unit, via which, in an energized state, an armature mounted for movement along a longitudinal axis of the control device can be moved relative to a pole core between a retracted position and an extended position; at least one tappet, which is mounted for movement along the longitu-
(Continued)

dinal axis and, in an extended position, interacts with the camshaft via a free end in order to adjust the camshaft and is connected at an inner end to the armature, wherein the tappet has a first diameter in the region of the free end and has a second diameter in the region of the inner end, and the first diameter is greater than the second diameter.

10 Claims, 1 Drawing Sheet

(51) Int. Cl.
*F01L 1/047* (2006.01)
*H01F 7/16* (2006.01)

(52) U.S. Cl.
CPC ..... *F01L 2820/031* (2013.01); *H01F 7/1607* (2013.01); *H01F 7/1646* (2013.01)

(56) References Cited

U.S. PATENT DOCUMENTS

| | | | | |
|---|---|---|---|---|
| 2009/0189724 | A1 | 7/2009 | Golz et al. | |
| 2010/0192885 | A1 | 8/2010 | Golz et al. | |
| 2013/0293035 | A1* | 11/2013 | Elendt ..... | H02K 33/00 310/12.32 |
| 2014/0253265 | A1 | 9/2014 | Suzuki et al. | |
| 2016/0125990 | A1 | 5/2016 | Strigerwald et al. | |
| 2016/0125991 | A1 | 5/2016 | Wardle et al. | |
| 2016/0290200 | A1* | 10/2016 | Stang ..... | F01N 3/2066 |
| 2017/0125147 | A1 | 5/2017 | Wardle et al. | |
| 2018/0144855 | A1 | 5/2018 | Halder et al. | |

FOREIGN PATENT DOCUMENTS

| | | |
|---|---|---|
| DE | 102009015833 | 10/2010 |
| DE | 102013204878 | 9/2013 |
| DE | 102013001487 | 7/2014 |
| DE | 102013102241 | 9/2014 |
| DE | 102014109124 | 12/2015 |
| DE | 102015120867 | 7/2016 |
| EP | 1421591 | 5/2004 |
| EP | 2158596 | 3/2010 |
| EP | 3016117 | 5/2016 |
| JP | 2015098841 | 5/2015 |
| WO | 2008/014996 | 2/2008 |
| WO | 2010112111 | 10/2010 |
| WO | 2016/001254 | 1/2016 |

OTHER PUBLICATIONS

World Intellectual Property Office, "International Search Report," and English translation thereof, issued for International Patent Application No. PCT/EP2017/071217, dated Dec. 18, 2017, document of 7 pages.

German Patent Office, "Office Action" issued in German Patent Application No. 10 2016 116 777.0, dated May 31, 2017, document of 8 pages.

* cited by examiner

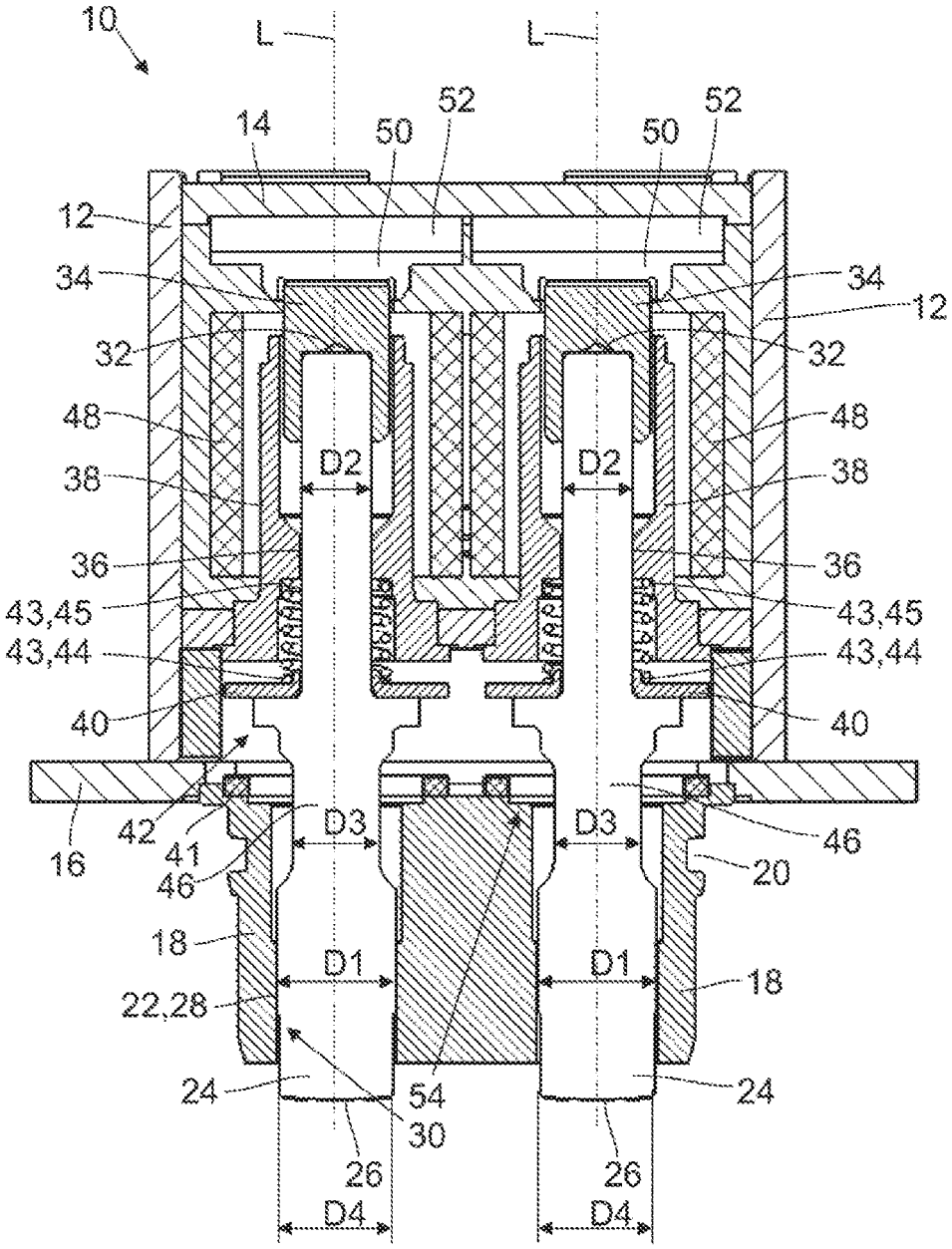
10
L
L
14
50
52
50
52
12
34
34
12
32
32
48
48
38
38
D2
D2
36
36
43,45
43,45
43,44
43,44
40
40
16
42
41
46
D3
D3
46
20
18
18
D1
D1
22,28
24
24
54
30
26
26
D4
D4

ELECTROMAGNETIC CONTROL DEVICE, IN PARTICULAR FOR ADJUSTING CAMSHAFTS OF AN INTERNAL COMBUSTION ENGINE

CROSS REFERENCE TO RELATED APPLICATIONS

This application is a §371 National Phase of PCT/EP2017/071217, filed Aug. 23, 2017, the entirety of which is incorporated by reference and which claims priority to German Patent Application No. 10 2016 116 770.0, filed Sep. 7, 2016.

BACKGROUND

The present application relates to an electromagnetic control device, in particular for adjusting camshafts of an internal combustion engine.

SUMMARY

Camshafts have a number of cams, which represent eccentric sections on the camshaft. The cams can either be fixedly arranged on the camshaft or on camshaft sections which can be mounted on a cylindrical shaft in a rotationally fixed but axially movable manner. Components arranged adjacent to the cams and movable in the axial direction can be moved at regular intervals together with the cams by rotating the camshaft. An application of the camshafts to be emphasized in this context is the opening and closing of valves in an internal combustion engine. In modern internal combustion engines, the engine characteristics can be changed, for example from a more comfortable characteristics to sporty characteristics, which change is implemented, for example, by changing the valve lift, which is determined by the shape of the cams. In addition, different engine speeds require variable valve lifts to optimize the torque and fuel consumption. Specific internal combustion engines include cylinder deactivation, whereby some of the cylinders can be deactivated to save fuel. In this case, the valves of the deactivated cylinders do not need to be opened at all. It is also advantageous in these internal combustion engines to not just deactivate individual cylinders but to allow variable valve lifts for the reasons mentioned above.

Such internal combustion engines require camshafts comprising cams of different sizes and shapes. To be able to open and close a valve by means of these different lift curves, the camshaft or camshaft section must be moved in the axial direction to allow the respective cams to interact with the valve. In known control devices, which are described, for example, in EP 2 158 596 B1, DE 20 2006 011 904 U1, and WO 2008/014996 A1, the camshafts have various grooves in which an actuator engages with a differing number of tappets. The tappets can be moved between a retracted position and an extended position, wherein the tappets engage in the grooves in the extended position. The grooves represent a guiding section and, together with the engaging tappets, form a slide guide for axial adjustment of the camshaft, which must be rotated by a specific measure for this purpose.

Most standard four-stroke internal combustion engines rotate the camshafts at half the speed of the crankshaft, which means that the camshafts can rotate at speeds of up to 3000 rpm and more. As a result of these high rotational speeds, great forces act on the tappets orthogonally to their longitudinal axis. The resulting bending moments which act on the tappets can cause the tappets to bend far enough to become jammed in the control device. Consequently, they can no longer be moved between the retracted and extended positions, thereby preventing the camshaft or camshaft section from moving in the axial direction.

To counteract this disadvantage, the tappet according to DE 10 2013 102 241 A1 is mounted at two clearly spaced apart bearing points, wherein one of these bearing points is located in the pole core. In WO 2016/001 254 A1, the tappet is also supported at two bearing points, one of which bearing points is arranged in the armature.

To keep wear and tear of the free end of the tappet, which engages in the groove of the camshaft, as low as possible, the tappet is rotatably mounted in the control device. In contrast, the armature in DE 10 2013 102 241 A1 and WO 2016/001 254 A1 is connected to the tappet by means of a clearance fit. Consequently, only axial forces can be transmitted between the tappet and the armature, but no torques which act around the longitudinal axis. The rotation of the tappet when engaging in the groove is therefore not transmitted to the armature. The rotation of the tappet relative to the armature creates wear points where the armature and the tappet come into contact, at which wear points the tappet and/or armature wear off over time in the operation of the control device. This can particularly change the axial position of the armature relative to the tappet, such that the tappet can no longer engage in the groove in the required measure. As a result, malfunctions or even failures can occur.

It is the problem of one embodiment of the application to create an electromagnetic control device, in particular for adjusting camshafts or a camshaft section of an internal combustion engine, with which the disadvantages mentioned above can be eliminated or at least noticeably reduced. In particular, a control device is to be created which can safely absorb the high bending moments which act on the tappet while in operation, thereby preventing the tappet from becoming jammed. At the same time, it is intended to reduce wear and tear between armature and tappet, such that their relative position and in particular their relative axial position does not change during operation.

One embodiment of the application relates to an electromagnetic control device, in particular for adjusting camshafts or a camshaft section of an internal combustion engine, comprising: an energizable coil unit, by means of which, in the energized state, an armature mounted for movement along a longitudinal axis of the control device can be moved relative to a pole core between a retracted position and an extended position; at least one tappet, which is mounted for movement along the longitudinal axis and, in the extended position, interacts with the camshaft by means of a free end in order to adjust the camshaft and is connected at an inner end to the armature, wherein the tappet has a first diameter in the region of the free end and has a second diameter in the region of the inner end, and the first diameter is greater than the second diameter.

Where diameters of the tappet are mentioned below, these diameters do not just have an infinitesimal extension along the longitudinal axis of the tappet. Sections of the tappet which are conical or curved with respect to a section plane, in which sections the tappet has, in a strict mathematical sense, infinitely many diameters, are not meant to be included.

To keep the design changes for implementing the present disclosure as low as possible, the second diameter is expediently selected such that it can interact with existing armatures. Thus the second diameter is determined by the dimensions of the armature. Since the first diameter arranged in the region of the free end can be selected greater than the second diameter, bending of the tappet can be reduced, even if great forces act orthogonally to the longitudinal axis of the tappet, to such an extent that jamming in the control device can largely be ruled out. This noticeably reduces the probability of failure of the control device and contributes to the operational safety of the internal combustion engine. It has proven advantageous that the ratio between the first diameter and the second diameter is between 1.5 and 3, in particular between 1.6 and 2.5.

According to another embodiment, the tappet has a third diameter, which is smaller than the first diameter, between the region of the free end and the region of the inner end. In this embodiment, the weight gain of the tappet compared to known tappets is reduced or even compensated by saving material, without any noticeable increase of tappet bending at high bending moments. Since the tappets are accelerated very fast, it is ensured that the energy needed by the control device to move the tappets increases only slightly or not at all. In addition, the mass inertia of the tappets is kept low, such that the tappets can be accelerated without having to increase the strength of the spring elements.

It has proven useful to select a third diameter that is greater than the second diameter. This can, on the one hand, help keep the weight gain low compared to known tappets, on the other hand the bending stiffness of the tappet is not reduced too much. The third diameter can for example be selected from 1.1 times to 1.4 times greater than the second diameter.

In an embodiment developed further, the control device can include an adapter with which the control device can be fastened to a component, in particular a cylinder head cover, wherein said adapter forms a first bearing section for rotatably mounting the tappet in the adapter. The adapter can be used to allow well-fitting fastening of the control device to a component, in particular to the cylinder head cover. The adapter can be adapted to the geometrical properties of the cylinder head cover in a simple manner, without any need to change other components of the control device. The adapter contributes to allowing flexible use of the control device.

In an embodiment developed further, the tappet may have a bearing surface in the region of the free end, which surface interacts with the first bearing section. The arrangement of the bearing surface in the region of the free end ensures that the bending moments acting on the tappet are kept low, since the path between the application point of the forces acting onto the tappet orthogonally to its longitudinal axis and the bearing section is short in this embodiment.

In another embodiment, the tappet, between its free end and the bearing surface, can have a fourth diameter which is smaller than the first diameter. The bearing surface must have a high-quality finish to ensure reliable and wear-resistant mounting. Providing the necessary surface finish is relatively expensive, however. In this embodiment, the size of the bearing surface is reduced to a minimum, which also keeps the manufacturing costs of the bearing surface low. The fourth diameter must only be slightly smaller than the first diameter. The ratio between the first and the fourth diameters is in particular between 1.02 and 1.1. This ensures that the tools needed for manufacturing the bearing surface can easily be moved towards the bearing surface. This applies in particular when the further region with the third diameter follows towards the inner end.

Another embodiment or embodiment developed further is characterized in that the tappet forms an offset when transitioning from the first diameter to the fourth diameter. In this case, the tappet comprises a surface at the transition which substantially extends orthogonally to the longitudinal axis. By means of this surface, dirt can be moved out of the control device and in particular out of the adapter.

According to another embodiment, the control device forms a second bearing section for rotatably mounting of the tappet outside the armature. To keep wear and tear of the free end of the tappet, which engages in the groove of the camshaft, as low as possible, the tappet is rotatably mounted in the control device. In conventional control devices, the tappet is mounted in the armature by means of a clearance fit for rotation relative to the armature. As mentioned above, this will create wear points between the armature and the tappet such that the axial position between the armature and the tappet changes, which can result in functional impairment or functional failure of the control device. Since the control device forms a second bearing section for rotatably mounting the tappet outside the armature, the tappet and the armature can be pressed together to prevent rotation relative to each other. Consequently, the wear points are eliminated, such that the probability of wear-related functional impairment or functional failure is considerably reduced.

An embodiment developed further is characterized in that the tappet is made of stainless steel. Stainless steel is in many cases stronger than conventional steel, such that the tappets according to this embodiment can absorb even greater forces without jamming. In addition, the stainless steel can be hardened for absorbing even greater forces. It is an option in this context to use a non-magnetic or magnetizable stainless steel to prevent adverse influence on the course of the magnetic field lines generated by the coil unit in the energized state.

BRIEF DESCRIPTION OF THE DRAWING

An exemplary embodiment of the invention application will be described with reference to the enclosed figures below. Wherein:

FIG. 1 is a schematic sectional view of an exemplary embodiment of an electromagnetic control device as proposed herein.

DETAILED DESCRIPTION

FIG. 1 shows a schematic sectional view of an exemplary embodiment of an electromagnetic control device 10 according to the application. It is visible in FIG. 1 that the control device 10 comprises two identical structural units. The following description is of only one of the structural units for clarity reasons, wherein this description applies likewise to the other structural unit.

The control device 10 comprises a housing 12, which has a substantially tube-shaped design in the exemplary embodiment shown. With reference to the view selected in FIG. 1, the housing 12 is closed with a lid 14 at its top end and with a flange 16 at its bottom end. The control device 10 comprises an adapter 18 that can be attached to the flange 16. This adapter 18 can be used to fasten the control device 10 to a cylinder head cover of an internal combustion engine, for example (not shown). The adapter 18 comprises recesses 20 into which seals not shown can be inserted to seal the control device 10 from the cylinder head cover.

The adapter 18 forms a first bearing section 22 for a tappet 24 which can be moved along a longitudinal axis L of the control device 10. The tappet 24 has a free end 26, which projects from the adapter 18. The tappet 24 has a first diameter D1 in the region of the free end 26. In the first bearing section 22, the inner surface of the adapter 18, which interacts with the tappet 24, has a respective surface finish.

In the region of the free end 26, the tappet 24 has a bearing surface 28 which interacts with the bearing section 22. The bearing surface 28 also has a respective surface finish. Between the bearing surface 28 and the free end 26, the tappet 24 has a fourth diameter D4, which is only slightly smaller than the first diameter D1. The tappet 24 forms an offset 30 at the transition from the first diameter D1 to the fourth diameter D4.

The first bearing section 22 is lubricated by means of the engine oil of the internal combustion engine. For safe absorption of the great axial forces which act on the tappet 24 during operation, both the tappet 24 and the adapter 18 are made of a hardened stainless steel.

Furthermore, the tappet 24 has an inner end 32. In the region of the inner end 32, the tappet 24 has a second diameter D2, which is smaller than the first diameter D1 and the fourth diameter D4. Furthermore, the inner end 32 of the tappet 24 is pressed together with an armature 34 and connected to it in a rotationally fixed manner. The rotationally fixed connection can also be implemented in a different manner, for example by welding. To achieve good compression, the armature 34 has a recess into which the tappet 24 engages.

The control device 10 has a second bearing section 36, which in the exemplary embodiment shown is arranged behind the first bearing section 22, starting from the free end 26, and formed by a tube-shaped body 38. In the example shown, the second bearing section 36 is arranged such that only the tappet 24 is mounted in the second bearing section 36. Consequently, the second bearing section 36 is inside the housing 12, while the first bearing section 22 is in the adapter 18 and thus located outside the housing 12. Both the first bearing section 22 and the second bearing section 36 are configured such that the tappet 24 and the armature 34 are mounted for rotation about the longitudinal axis L and for movement along the longitudinal axis L. In the exemplary embodiment shown, the tappet 24 has the second diameter D2 where it interacts with the second bearing section 36.

Furthermore, the control device 10 comprises a spring plate 40, which embraces the tappet 24 in an annular configuration, has a clearance fit with respect to the tappet 24, and rests against the tappet 24 in the region of a diameter enlargement 42 of said tappet. In the extended position, the diameter enlargement 42 of the tappet 24 rests against the adapter 18. The diameter enlargement 42 thus acts as a stop. The diameter enlargement 42 is dimensioned such that it gives the tappet 24 the necessary stability. At the same time, the diameter enlargement 42 is used as a support for the spring plate 40, which is attracted by a permanent magnet 41 and holds the tappet 24 in the extended position, such that the tappet 24 is not inadvertently moved towards the retracted position, for example by viscous oil.

In addition, a spring element 43 is provided, which has a first end 44 and a second end 45. The spring element 43 can provide a biasing force which substantially acts along the longitudinal axis L. At its first end 44, the spring element 43 is supported by the spring plate 40; at its second end 45, it is supported by the tube-shaped body 38. The spring plate 40 thus performs the same axial movements along the longitudinal axis L as the armature 34 and the tappet 24. Due to the clearance fit of the spring plate 36 with respect to the tappet 24, the rotational movements of the tappet 24 are only transmitted to the spring plate 40 when the biasing force with which the spring plate 40 is pressed against the diameter enlargement 42 exceeds a specific value.

The tappet 24 comprises another region 46 between the region of the free end 26 and the region of the inner end 32 in which the tappet has a third diameter D3. In the exemplary embodiment shown, the third diameter D3 is smaller than the first diameter D1 and the fourth diameter D4 but greater than the second diameter D2.

For moving the armature 34, the control device 10 includes a coil unit 48, which encloses the armature 34 in an annular configuration, thereby forming a gap. In addition, a pole core 50 is provided, which is arranged above the armature 34 with respect to the view selected in FIG. 1. Furthermore, the control device 10 comprises another permanent magnet 52, which is fastened to the lid 14 and arranged above the pole core 50.

Since the armature 34 and the tappet 24 are pressed together, they perform the same movements. The tappet 24 and the armature 34 thus do not perform any movements relative to each other, which means that there are no wear points due to relative movements between the armature 34 and the tappet 24.

The control device 10 is operated as follows: The other permanent magnet 52 applies an attractive force acting along the longitudinal axis L to the armature 34, such that, in the retracted state, the armature 34 is attracted by the other permanent magnet 52 and rests against the pole core 50. This compresses the spring element 43, such that the spring element 43 provides a biasing force, which however is smaller than the attractive force of the other permanent magnet 52. As a result, the armature 34 and the tappet 24 adopt a retracted position (see FIG. 1).

If the coil unit 48 is energized, a magnetic field is built which induces a magnetic force that acts in the same direction on the armature 34 as the biasing force provided by the spring element 43 and therefore counteracts the attractive force of the other permanent magnet 52. The sum total of the magnetic force and the biasing force is greater than the attractive force of the other permanent magnet 52, such that the armature 34 and consequently the tappet 24 are moved away from the other permanent magnet 52 along the longitudinal axis L until the spring plate 40 contacts a stop 54, in which way the tappet 24 and the armature 34 have reached an extended position (not shown). In this extended position, the free end 26 of the tappet 24 engages in a groove of a camshaft not shown or a camshaft section not shown. The groove has a helical course relative to the rotational axis of the camshaft, such that engagement of the tappet 24 in the groove in combination with the rotation of the camshaft about its own rotational axis causes a longitudinal adjustment along the rotational axis of the camshaft. To transmit the respective axial forces, the tappet 24 is in contact with one of the side walls of the groove and rolls along it, such that the tappet 24 is rotated at a high rotational speed when engaging in the groove. The rotational movement of the tappet 24 is also transmitted to the armature 34 since the armature 34 and the tappet 24 are pressed together. The stop 54 of the adapter 18 and the depth of the groove are selected such that the free end 26 of the tappet 24 does not contact the bottom surface of the groove in the extended position. To prevent the tappet 24 from being moved back into the retracted position, for example by viscous oil which accumulates under the tappet 24, the tappet 24 is held in its extended position by the permanent magnet 41 in the diameter enlargement 42. But the depth of the groove declines towards the end, such that the free end 26 of the tappet 24 contacts the bottom surface of the groove from a specific angle of rotation, whereby the tappet 24 is once again moved towards the other permanent magnet 52, whereby the holding force of the permanent magnet 41, which gets smaller as the distance of the diameter enlargement 42 from the permanent magnet 41 increases, is overcome. As soon as the tappet 24 is moved from the groove towards the retracted position, energization of the coil unit 48 is interrupted, such that the attractive force applied by the other permanent magnet 52 to the armature 34 is once again greater than the sum total of the biasing force provided by the spring element 43 and the magnetic force which is no longer active due to lack of energization of the coil unit 48. As a result, the tappet 24 and the armature 34 once again adopt the retracted position until the coil unit 48 is energized again.

Since the tappet 24 comprises in the region of its free end 26 the first diameter D1, which is greater than the second diameter D2 in the region of the inner end 32, the tappet 24 has a high bending stiffness compared to known tappets, such that high bending moments can be absorbed without causing bending of the tappet 24 and any resulting jamming in the two bearing sections 22, 36. The other region 46 with the third diameter D3 is designed such that, on the one hand, the weight of the tappet 24 increases just slightly or not at all compared to known tappets, but increased bending stiffness is maintained.

The offset 30 causes dirt which accumulates between the adapter 18 and the tappet 24 in the region of the free end 26 is pushed out of the adapter 18 when the tappet 24 is moved by from the retracted position into the extended position. This prevents blockage of the tappet 24 or damage to the first bearing section 22 due to ingression of dirt particles.

LIST OF REFERENCE SYMBOLS

10 Control device
12 Housing
14 Lid
16 Flange
18 Adapter
20 Recess
22 First bearing section
24 Tappet
26 Free end
28 Bearing surface
30 Offset
32 Inner end
34 Armature
36 Second bearing section
38 Tube-shaped body
40 Spring plate
41 Permanent magnet
42 Diameter enlargement
43 Spring element
44 First end
45 Second end
46 Other region
48 Coil unit
50 Pole core
52 Other permanent magnet
54 Stop
D1 First diameter
D2 Second diameter
D3 Third diameter
D4 Fourth diameter
L Longitudinal axis

The invention claimed is:

1. An electromagnetic control device, comprising:
an armature;
an energizable coil unit, with which, in the energized state, the armature is mounted for movement along a longitudinal axis of the control device and is movable between a retracted position and an extended position;
a tappet, which is mounted for movement along the longitudinal axis and, in the extended position, interacts with a camshaft via a tappet free end in order to adjust the camshaft and is connected at a tappet inner end to the armature;
wherein the tappet has a first diameter in a region of the tappet free end and has a second diameter in a region of the tappet inner end;
wherein the first diameter is greater than the second diameter; and
further comprising an adapter with which the control device can be fastened to a component, wherein the adapter forms a first bearing section for rotatably mounting the tappet in the adapter,
wherein the tappet, in the region of the tappet free end, has a bearing surface which interacts with the first bearing section,
wherein the tappet, between the region of the tappet free end and the region of the tappet inner end, comprises another region having a third diameter, wherein the third diameter is smaller than the first diameter,
wherein the tappet, between the tappet free end and the bearing surface, has a fourth diameter which is smaller than the first diameter.

2. The electromagnetic control device according to claim 1, wherein the tappet forms an offset at a transition from the first diameter to the fourth diameter.

3. The electromagnetic control device according to claim 1, further comprising a second bearing section for rotatably mounting the tappet outside the armature.

4. The electromagnetic control device according to claim 1, wherein the tappet is stainless steel.

5. A device, comprising:
a housing having a longitudinal axis;
a biasing spring that acts along the longitudinal axis;
an energizable coil unit located in the housing;
a tappet that extends along the longitudinal axis and comprises:
a tappet free end for interaction with a camshaft;
a tappet armature end that connects to an armature;
a tappet adapter section located exterior to the housing, wherein the tappet adapter section has a first diameter;
a tappet armature section located within the housing and having a second diameter;
a tappet middle section located between the tappet adapter section and the tappet armature section, wherein the tappet middle section has a third diameter;
a tappet offset section located proximate to the tappet adapter section, wherein the tappet offset section has a fourth diameter;
wherein the first diameter is greater than the second diameter; and
wherein the tappet is rotatably mounted such that rotation of the tappet is not transferred to the spring.

6. The device according to claim 5, wherein the third diameter is smaller than the first diameter.

7. The device according to claim 5, further comprising:
an adapter extending from the housing and having a first bearing section for movably mounting the tappet, wherein the first bearing section is located in the adapter and outside of the housing, and wherein the first bearing section extends along the tappet adapter section.

8. The device according to claim 7, wherein the tappet offset section extends beyond the adapter.

9. An electromagnetic control device, comprising:

an armature;

an energizable coil unit, with which, in the energized state, the armature is mounted for movement along a longitudinal axis of the control device and is movable between a retracted position and an extended position;

a tappet, which is mounted for movement along the longitudinal axis and, in the extended position, interacts with a camshaft via a tappet free end in order to adjust the camshaft and is connected at a tappet inner end to the armature;

wherein the tappet has a first diameter in a region of the tappet free end and has a second diameter in a region of the tappet inner end, and wherein the first diameter is greater than the second diameter, further comprising an adapter with which the control device can be fastened to a component, wherein the adapter forms a first bearing section for rotatably mounting the tappet in the adapter, wherein the tappet, in the region of the tappet free end, has a bearing surface which interacts with the first bearing section, wherein the tappet, between the tappet free end and the bearing surface, has a fourth diameter which is smaller than the first diameter, further comprising a second bearing section for rotatably mounting the tappet outside the armature.

10. An electromagnetic control device, comprising:

an armature;

an energizable coil unit, with which, in the energized state, the armature is mounted for movement along a longitudinal axis of the control device and is movable between a retracted position and an extended position;

a tappet, which is mounted for movement along the longitudinal axis and, in the extended position, interacts with a camshaft via a tappet free end in order to adjust the camshaft and is connected at a tappet inner end to the armature;

wherein the tappet has a first diameter in a region of the tappet free end and has a second diameter in a region of the tappet inner end, and wherein the first diameter is greater than the second diameter, further comprising an adapter with which the control device can be fastened to a component, wherein the adapter forms a first bearing section for rotatably mounting the tappet in the adapter, wherein the tappet, in the region of the tappet free end, has a bearing surface which interacts with the first bearing section, wherein the tappet, between the tappet free end and the bearing surface, has a fourth diameter which is smaller than the first diameter, further comprising a second bearing section for rotatably mounting the tappet outside the armature, and a spring plate, which embraces the tappet in an annular configuration, has a clearance fit with respect to the tappet, and rests against the tappet in the region of a diameter enlargement of said tappet.

* * * * *